US006373039B2

(12) United States Patent
Lee

(10) Patent No.: US 6,373,039 B2
(45) Date of Patent: Apr. 16, 2002

(54) DAMPING DEVICE IN MICROWAVE OVEN

(75) Inventor: Soon Jo Lee, Kyongsangnam-do (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/739,019

(22) Filed: Dec. 19, 2000

(30) Foreign Application Priority Data

Dec. 20, 1999 (KR) ..... 99/59240

(51) Int. Cl.[7] ..... H05B 6/66; H05B 6/80
(52) U.S. Cl. ..... 219/757; 219/702; 126/21 A
(58) Field of Search ..... 219/757, 681, 219/702, 752, 753, 400; 126/21 A

(56) References Cited

U.S. PATENT DOCUMENTS 4,450,344 A * 5/1984 Sakoda et al. ..... 219/757
5,804,800 A * 9/1998 Lee et al. ..... 219/753
6,201,225 B1 * 3/2001 Lee ..... 219/757
6,209,503 B1 * 4/2001 Komada et al. ..... 123/184.56

FOREIGN PATENT DOCUMENTS

JP 4-161725 * 6/1992 ..... 219/757

* cited by examiner

*Primary Examiner*—Philip H. Leung
(74) *Attorney, Agent, or Firm*—Fleshner & Kim, LLP

(57) ABSTRACT

Damping device in a microwave oven including an air duct on an electrical compartment side of a partition wall for guiding an air flow from a cooing fan to a cooking chamber, a damper rotatably hinged on the air duct for selectively blocking the air duct, a driving cam having a relative thickness difference between a thick portion and a thin portion, rotatable in contact with one end of the damper for pressing the one end of the damper to rotate the damper centered on the hinge owing to the thickness difference, and control means for controlling rotation of the driving cam, thereby providing a smooth damping operation, reducing a device cost, and preventing the microswitch from being pressed excessively.

20 Claims, 7 Drawing Sheets

DAMPING DEVICE IN MICROWAVE OVEN

BACKGROUND OF THE INVENTION

1. Field of the Invention

The present invention relates to a microwave oven, and more particularly, to a damping device in a microwave oven for regulating an air flow to a cooking chamber.

2. Background of the Related Art

The microwave oven is an appliance for disturbing an array of water molecules in food by means a microwave as a heat source, to generate a heat caused by friction between the molecules, for cooking food. The microwave oven has a convection function in which food is cooked, or a surface of food is browned by a heat from a heater, together with the microwave oven function. As shown in FIG. 1, the microwave oven is provided with a body 10, a cooking chamber 20 in one side portion of the body 10 for cooking, an electrical compartment 30 in the other side portion of the body for fitting various components required for driving the device, and a partition wall 40 for partitioning the cooking chamber and the electrical compartment 30. The electrical compartment 30 is provided with a magnetron 31 for generating a microwave, a transformer 32 for transforming a utility voltage to a voltage required for the magnetron, a cooling fan 33 for cooling the magnetron, and an air duct 34 for guiding an air flow caused by rotation of the cooling fan to a pass through hole(see 41 in FIG. 2A) in the partition wall 40 into the cooking chamber. And, there is a heater(not shown) for generating a heat when the convection function is selected.

In the meantime, during the cooking by using the convection function when the cooking is conducted by using a heat from the heater, the microwave oven can not conduct the convection function properly since the air flow from the cooling fan 33 comes into the cooking chamber 20 through the air duct 34 and drops a temperature of the cooking chamber 20 heated by the heater. In order to block the air flow from the cooling fan 33 to the cooking chamber 20, a damping device is disclosed in Korean Patent No. 99-35944 for selective blocking of the air duct.

As shown in FIGS. 2A and 2B, the damping device disclosed in Korean Patent No. 99-35944 is provided with a damper 51 rotatably fitted in the air duct 34 for blocking the air flow toward the cooking chamber, and bidirectional motor 52 fitted to the air duct and coupled with the damper for rotating the damper 51. There is also a microswitch 53 fitted to one side of the air duct 34 for providing a control signal to a microcomputer(not shown) to control operation of the bidirectional motor 52, a push button 54 projected from one end of the damper 51 for pressing the microswitch when the damper rotates, and a stopper 55 fitted to a pass through hole 41 side of the partition wall inside of the air duct for stopping rotation of the damper.

The operation of the foregoing damping device will be explained.

First, as shown in FIG. 2A, in a convection mode, a regular direction rotation(rotation in a clockwise direction) of the damper 51 by the bidirectional motor 52 until an end 51 a thereof is stopped by the stopper 55 blocks the air duct 34. Then, the damper blocks the air duct so that the air flow can not come into the cooking chamber 20, thereby conserving the heat from the heater within the cooking chamber. And, at a moment the air duct 34 is blocked by the damper 51, the push button 54 is caused to press the microswitch 53, a signal generated at this moment is provided to the microcomputer, to stop operation of the bidirectional motor 52.

Second, as shown in FIG. 2B, in a microwave mode, the damper 51 is rotated in a reverse direction(a rotation in an anti-clockwise direction) by the bidirectional motor 52, to open the air duct 34. According to this, the air flow from the cooling fan 33, moves in the air duct, enters into the cooking chamber 20 through the pass through hole 41 in the partition wall 40, and carries vapor in the cooking chamber 20 away from the microwave oven. And, when the air duct 34 is opened as the damper 51 is moved, the push button 54 is freed from the microswitch 53, and a signal generated in this instance is provided to the microcomputer(not shown), and the microcomputer stops the bidirectional motor 52.

However, the aforementioned related art damping device has the following problems.

First, in the related art damping device, the bringing into contact of the push button 54 to an actuator 53*a* in the microswitch 53 during the rotation of the damper may cause to provide an excessive force to the actuator 53*a* or generate noise. That is, referring to FIG. 2A, it can be known that an extent of actuator 53*a* pressing is dependent on a position of the stopper 55 fitting. Because there may be fabrication errors between components, inclusive of the push button 54 on the damper 51, the stopper 55 on the partition wall 40. For an example, if the stopper 55 is fitted closer to the pass through hole 41 side owing to a fabrication error, the damper 51 stops before the push button 54 presses the actuator 53*a*, which makes control of the bidirectional motor impossible. However, since the damping device becomes inoperative if the bidirectional motor is not controllable, the stopper is in general fitted to a place away from the pass through hole side. Consequently, since the damping device comes to a stop after the push button presses the actuator, excessively (see a dashed line in FIG. 2A), it is liable that an excessive pressure is provided to the microswitch 53. Moreover, since various mating components are fitted to different members for use in controlling operation of the bidirectional motor 52, the liability that an excessive pressure is provided to the microswitch 53 becomes further higher after an assembly. That is, the fabrication error in the assembly of the partition wall 40 having the stopper 55 fitted thereto, the damper 51 having the push button 54 fitted thereto, and the air duct 34 having the microswitch 53 fitted thereto may make the liability further higher. Consequently, the excessive pressure to the microswitch 53 may cause problems, not only in a driving performance of the microswitch itself, but also in noise occurrence, or in a lifetime of the microswitch 53 coming from an excessive contact between the push button 54 and the microswitch 53.

Second, the mounting of the bidirectional motor 52 to an upper part of outside of the air duct 34 in the related art damping device is limited by an oven lamp(not shown) and an upper case 11 in view of space, which prolongs the assembly process, and makes an interchangeability with other large sized components poor, that results in a high cost.

Third, the direct coupling of the damper 51 with the bidirectional motor 52 in the related art damping device fixes a direction of rotation of the damper only by the motor. That is, a regular direction rotation of the damper requires a regular direction rotation of the motor, and a reverse direction rotation of the damper requires a reverse direction rotation of the motor, no motor, but the bidirectional motor, can be used. The use of the bidirectional motor 52 results in a high cost and complicate system.

SUMMARY OF THE INVENTION

Accordingly, the present invention is directed to a damping device in a microwave oven that substantially obviates one or more of the problems due to limitations and disadvantages of the related art.

An object of the present invention is to provide a damping device in a microwave oven, which has a smooth operation and a low cost.

Another object of the present invention is to provide a damping device in a microwave oven, which can eliminate an excessive pressure to the microswitch.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the damping device in a microwave oven includes an air duct on an electrical compartment side of a partition wall for guiding an air flow from a cooing fan to a cooking chamber, a damper rotatably hinged on the air duct for selectively blocking the air duct, a driving cam having a relative thickness difference between a thick portion and a thin portion, rotatable in contact with one end of the damper for pressing the one end of the damper to rotate the damper centered on the hinge owing to the thickness difference, and control means for controlling rotation of the driving cam.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In explanation of the present invention, components identical to the related art will be given identical names and reference symbols, and detailed explanation of which will be omitted.

Figure 1:
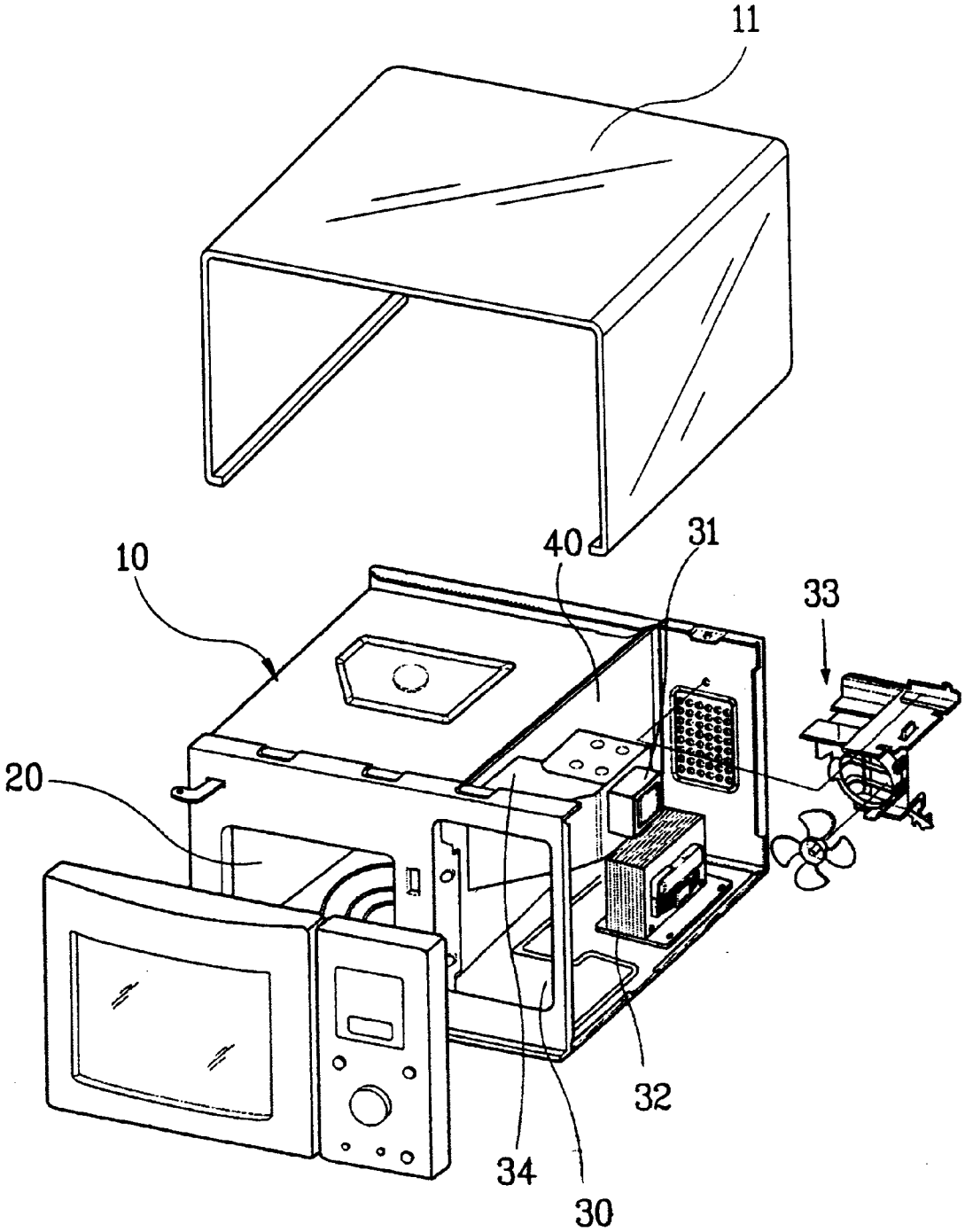
FIG 1 Related Art
FIG. 1 illustrates a disassembled perspective view of a related art microwave oven.
Figure 3A:
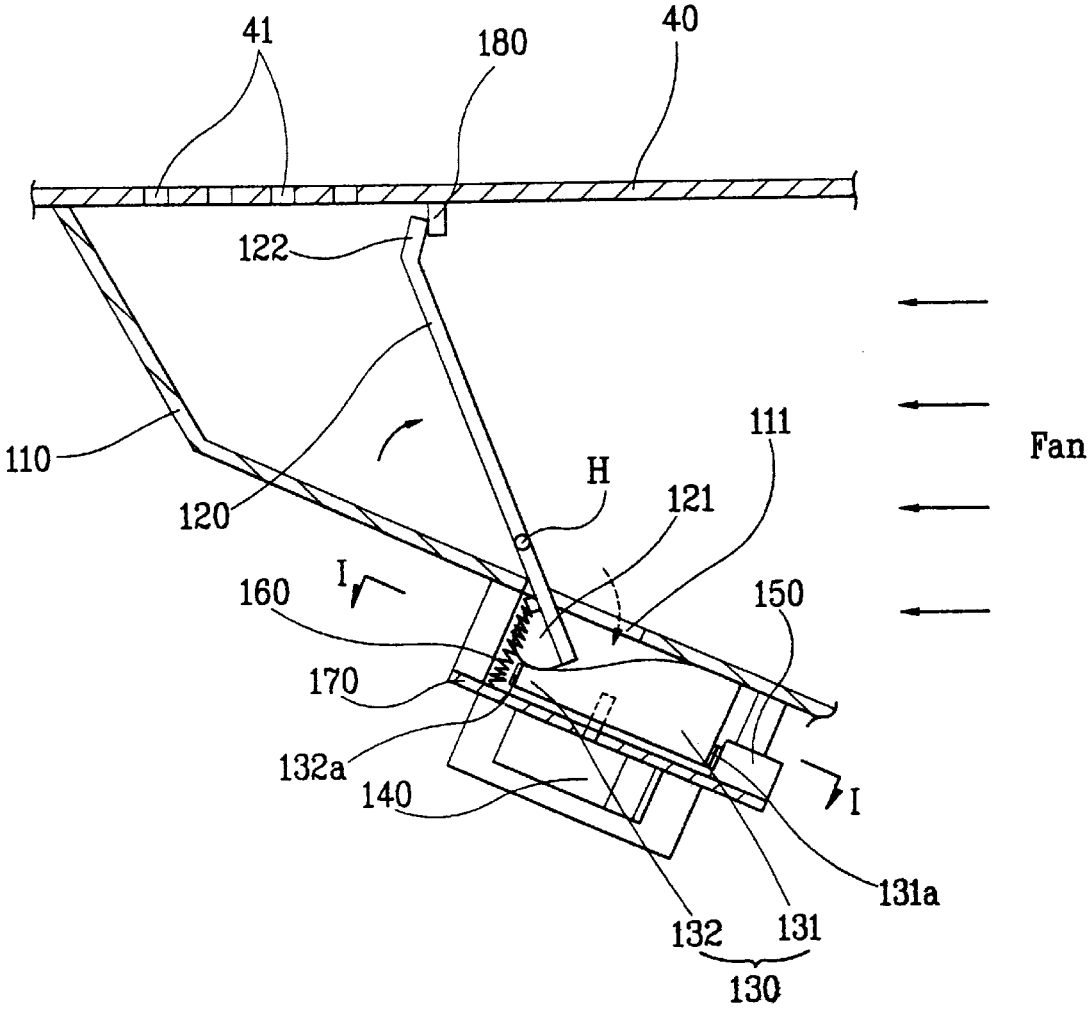
FIG. 3A illustrates a section of key part of a damping device in a convection mode in accordance with a preferred embodiment of the present invention.
Figure 3B:
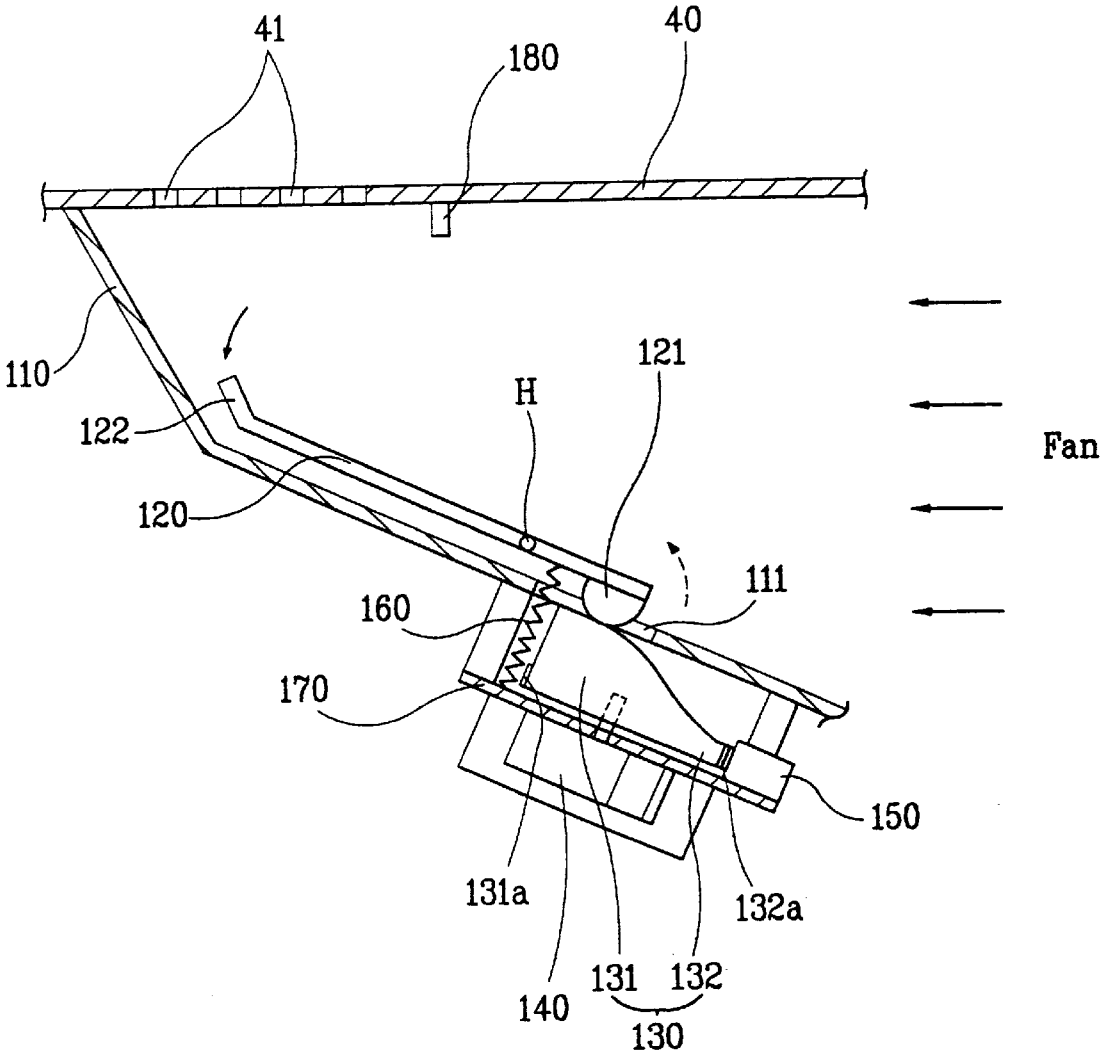
FIG. 3B illustrates a section of key part of a damping device in a microwave mode in accordance with a preferred embodiment of the present invention.
Figure 4:
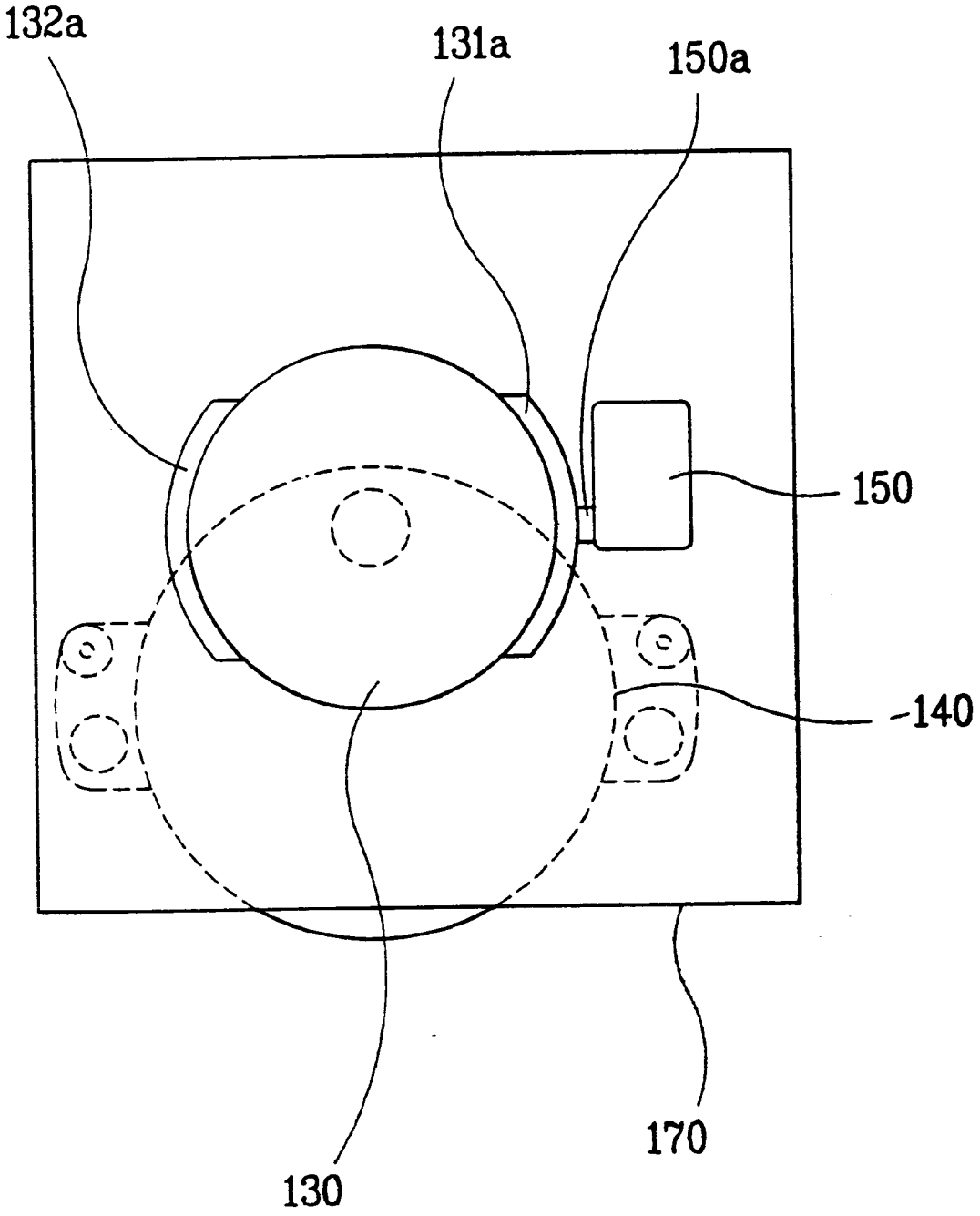
FIG. 4 illustrates a section across a line I—I in FIG. 3B.
Figure 5:
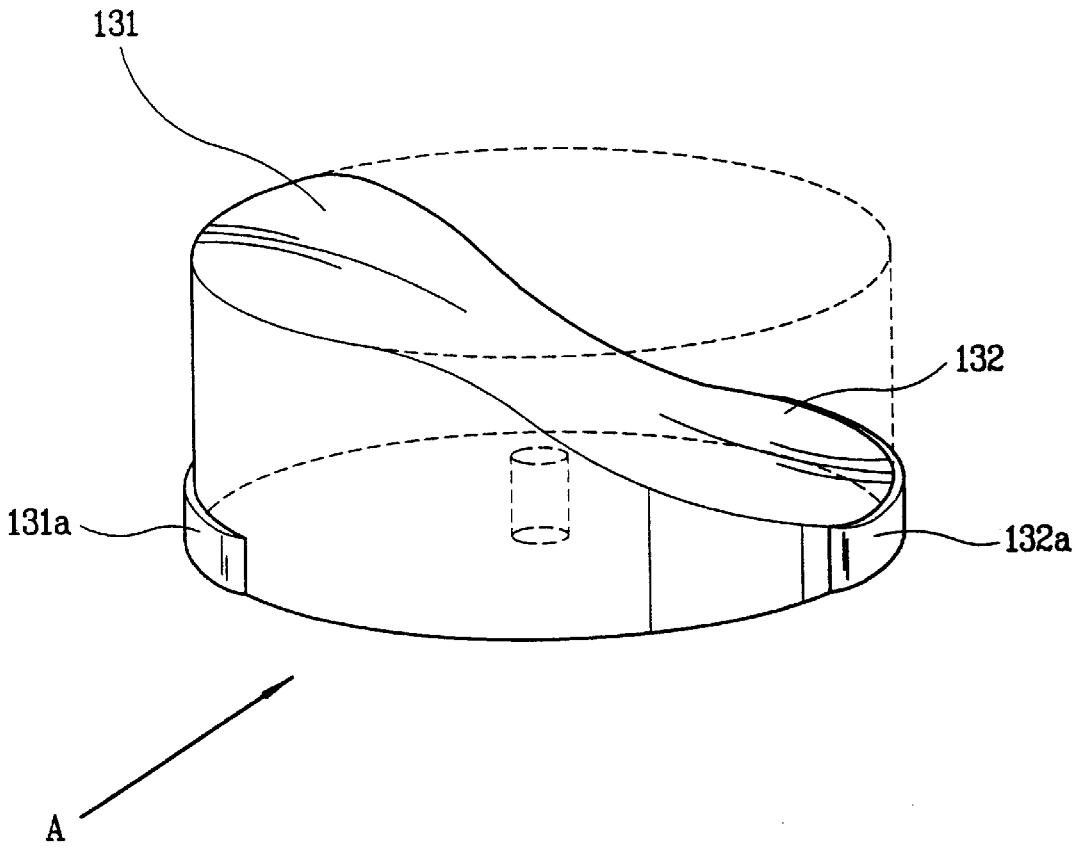
FIG. 5 illustrates a perspective view of a cam of the present invention.

Referring to FIGS. 3A~5, the damping device in a microwave oven in accordance with a preferred embodiment of the present invention includes an air duct 110 in an electrical compartment(see 30 in FIG. 1) for guiding an air flow caused by rotation of a cooling fan 33 to a cooking chamber 20, a damper 120 rotatably hinged on the air duct for selective blocking of the air duct, a driving cam 130 having a relative thickness difference between a thick portion 131 and a thin portion 132, rotatable in contact with one end 121 of the damper for pressing the one end 121 of the damper to rotate the damper centered on the hinge owing to the thickness difference, and control means for controlling rotation of the driving cam. As shown in FIG. 5, the driving cam 130 is cylindrical on the whole, preferably with a curved top surface to have different left/right thicknesses when seen from front(seen in 'A' direction). And, as shown in FIG. 3A, the control means preferably includes a motor 140 coupled to the driving cam 130 with a shaft for driving the driving cam, a microswitch 150 for providing an electric signal to the microcomputer (not shown) to stop/operate the motor selectively, and contacts 131*a* and 132*a* projected from an outer circumference of the driving cam to match with the microswitch for turning on/off the microswitch.

Figure 2A:
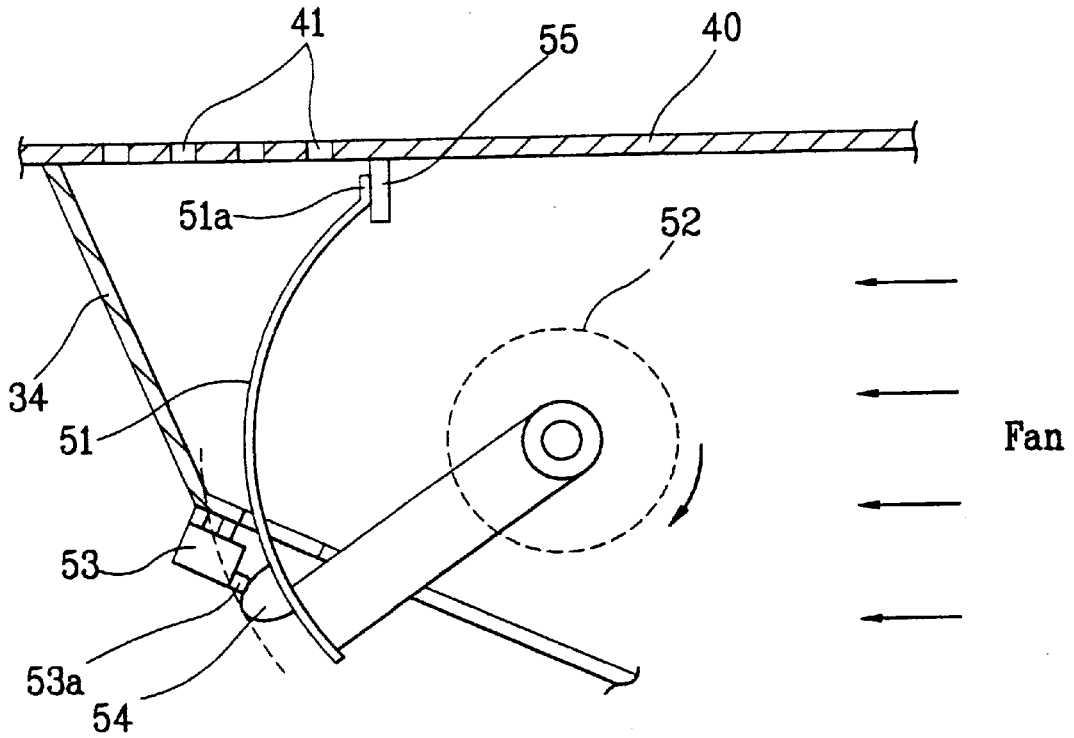
FIG . 2A Related Art
FIG. 2A illustrates a section of key part of a related art damping device in a convection mode.
Figure 2B:
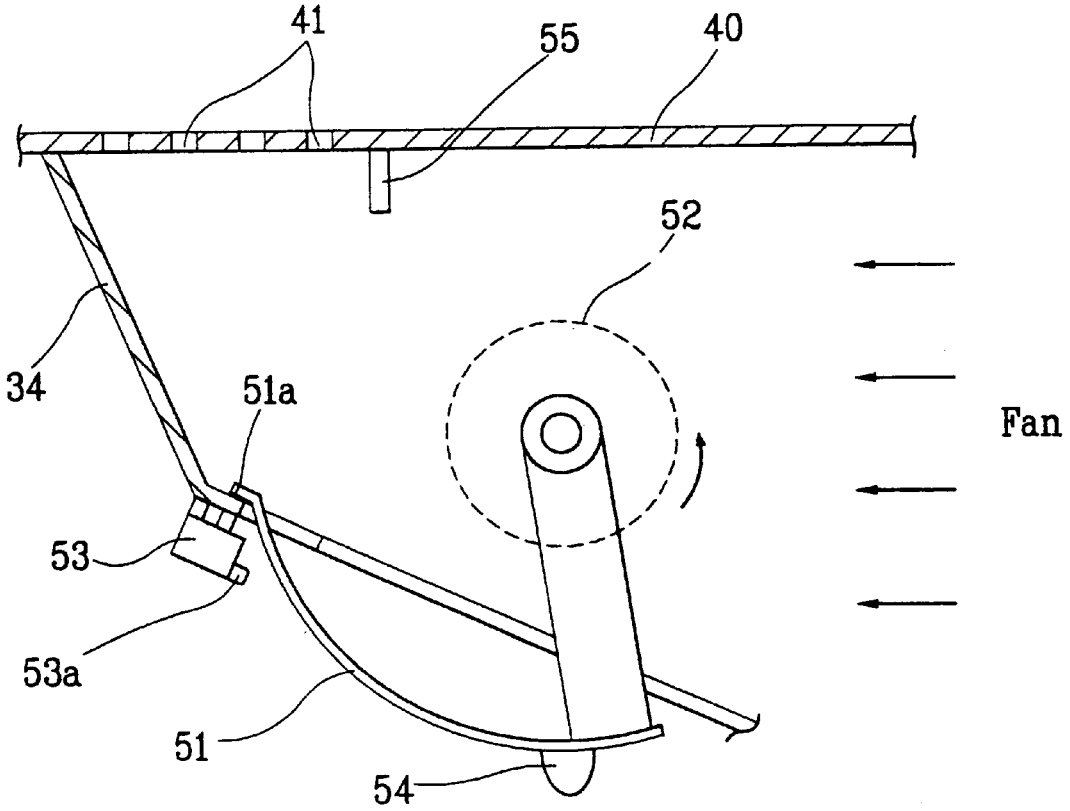
FIG . 2B Related Art
FIG. 2B illustrates a section of key part of a related art damping device in a microwave mode.

In this instance, of course the motor 140 may, or may not be a bidirectional, it is preferable that the motor 140 is one directional, because the damping device of the present invention permits to use the one directional motor which is low cost, that excludes the necessity for using the bidirectional motor. That is, while the related art damping device has a system in which the direction of rotation of the damper(see 51 in FIG. 2A) is reversed only by means of the bidirectional motor(see 52 in FIG. 2A), since the damping device of the present invention can change the rotation direction of the damper by using the thick portion 131 and the thin portion 132, a thickness difference of the driving cam, even if the motor rotates only in one direction owing to a separate driving cam 130 between the damper 120 and the motor 140, there is no reason to use the high cost bidirectional motor.

Along with this, as shown in FIGS. 4 and 5, it is preferable that the contacts 131*a* and 132*a* are respectively projected from left/right sides of the driving cam 130 with reference to a front of the driving cam 130(a portion seen in 'A' direction in FIG. 5), for positive control of the motor 140 which makes rotation of the driving cam. That is, as shown in FIG. 3A, in the convection mode, the one end 121 of the damper 120 is kept to be located at the thin portion 132 of the driving cam by stopping rotation of the driving cam at the moment the contact 131 a on the thick portion side 131 of the driving cam presses the microswitch 150, and, opposite to this, as shown in FIG. 3B, in the microwave mode, the one end 121 of the damper 120 is kept to be located at the thick portion of the driving cam by stopping rotation of the driving cam at the moment the contact 132*a* on the thin portion side 132 of the driving cam presses the microswitch 150. Thus, it is preferable that the contacts are respectively provided at the thick portion and the thin portion, the left/right sides, of the driving cam. And, as shown in FIGS. 3A and 3B, it is preferable that an elastic body 160 is provided to connect one end of the damper 120 and one side of the air duct 110 for keeping contact between the driving cam 130 and the one end 121 of the damper by providing an elastic force to the one end 121 of the damper. And, though not shown, a rail may be formed on one end of the damper and a guide groove is formed in a top surface of the driving cam, for inserting the rail in the guide groove for making the driving cam 130 and the one end 121 of the damper in contact. A specific reason that the driving cam 130 and the one end 121 of the damper are required to keep contact to each other is that, while the damper 120 is rotated by a pushing force from the thick portion when thick portion 131 of the driving cam is moved toward the one end 121 of the damper because the thick portion is positioned higher than the one end of the damper, the damper 120 is not rotated as there is no force exerting to the one end of the damper when thin portion 132 of the driving cam is moved toward the one end 121 of the damper because the thin portion is positioned lower than the one end of the damper, allowing the one end of the damper and the top surface of the driving cam to come away from each other. Therefore, it is required that the one end of the damper is made to keep contact with the top surface of the driving cam when the thin portion 132 of the driving cam is moved toward the one end 121 of the damper, for reversal of the damper 120. And, as shown in FIGS. 3A and 3B, the damping device of the present invention preferably further includes an opening 111 at a required portion of the air duct for avoiding interference between the one end of the damper and the air duct 110 when the damper is rotated, and a fastening bracket 170 fitted to outside of the air duct in the vicinity of opening thereof for fitting the driving cam 130 on an inside surface thereof and the motor 140 on an outside surface thereof. Together with these, as shown in FIGS. 3A and 3B, the damping device of the present invention preferably further includes a stopper 180 fitted to the partition wall 40 for stopping the damper when the damper blocks the air duct 110.

The operation of the aforementioned damping device of the present invention will be explained.

First, referring to FIG. 3A, in the convection mode, when the motor 140 is put into operation, the driving cam 130 is rotated, the one end 121 of the damper on the top surface of the driving cam is moved downward(a dashed lined arrow direction in FIG. 3A) owing to a thickness difference of the driving cam, and the other end 122 of the damper is rotated upward(a solid lined arrow direction in FIG. 3B) centered on the hinge shaft H. And, when the motor keeps to rotate until the contact 131*a* on the thick portion 131 of the driving cam presses the microswitch 150, an electrical signal generated at the microswitch is transmitted to the microcomputer(not shown), to stop the motor, while the one end of the damper comes to the thin portion 132 of the driving cam. As shown in FIG. 3A, the damper 120 blocks the air duct 110, with the other end 122 thereof stopped at the stopper 180, to block the air flow from the cooling fan 33 to the cooking chamber 20, facilitating to prevent a heat loss of the heater from the cooking chamber due to the air flow, in advance.

Second, as shown in FIG. 3B, in the microwave mode, when the motor 140 is put into operation, the driving cam 130 is rotated, and the one end 121 of the damper located on the top surface of the driving cam is moved upward(a dashed lined arrow direction in FIG. 3B) due to the thickness difference of the driving cam, while the other end 122 of the damper is moved downward(a solid lined direction in FIG. 3B) centered on the hinge shaft H. And, when the motor keeps to rotate until the contact 132*a* on the thin portion 132 of the driving cam comes to press the microswitch 150, the electrical signal generated at the microswitch is transmitted to the microcomputer(not shown), to stop the motor, and to rest the one end of the damper on the thick portion 131 of the driving cam. In this instance, as shown in FIG. 3B, the damper 120 opens the air duct 110, facilitating the air flow from the cooling fan 33 to the cooking chamber 20, to carry away the vapor and smell from the cooking chamber to outside of the microwave oven.

As has been explained, since the damping device in a microwave oven of the present invention facilitates use of one directional motor and improves a contact structure for pressing the microswitch by using the driving cam, the damping device has the following advantages.

First, the actuator 150*a* in the microswitch can be pressed with a regular force. That is, though the error caused by structural problem in the related art damping device results in the push button to press the microswitch excessively, the damping device of the present invention can prevent occurrence of the noise coming from excessive pressing of the contact to the actuator in the microswitch, since the damping device of the present invention has a structure in which contacts on left/right of the driving cam are made to press the microswitch as the motor is rotated.

Second, the spatial limitation from nearby components can be avoided.

Though the bidirectional motor in the related art mounted on an outside of the upper portion of the air duct has a spatial limitation from the oven lamp, the upper case, and the like, as the motor of the present invention is mounted, not on the outside of the upper/lower portion of the air duct, but on a side of the air duct, the space can be utilized to the maximum.

Third, unit cost of the device can be reduced.

Though the damping device in the related art requires a bidirectional motor, the damping device of the present invention permits to use even the one directional motor, which can reduce a unit cost.

The advantages are inclusive of all the effects described in the detailed description of the preferred embodiment of the present invention.

It will be apparent to those skilled in the art that various modifications and variations can be made in the damping device in a microwave oven of the present invention without departing from the spirit or scope of the invention. Thus, it is intended that the present invention cover the modifications and variations of this invention provided they come within the scope of the appended claims and their equivalents.

What is claimed is:

1. A damping device in a microwave oven, comprising:

an air duct on an electrical compartment side of a partition wall for guiding an air flow from a cooling fan to a cooking chamber;

a damper in the form of a lever mounted on the air duct and configured to pivot about a fulcrum to block the air duct;

a driving cam having a relative thickness difference between a thick portion and a thin portion, the driving cam bearing on one end of the damper for pressing the one end of the damper to pivot the damper as the driving cam rotates; and control means for controlling rotation of the driving cam.

2. The damping device as claimed in claim 1, wherein the driving cam is cylindrical, with a curved top surface having different left/right thicknesses when viewed from a front.

3. The damping device as claimed in claim 1, wherein the control means includes:

a motor coupled to the driving cam for driving the driving cam;

a microswitch for providing an electrical signal to the microcromputer for selective stop/run of the motor; and contacts projected from outer circumferential surfaces of the driving cam to mate with the microswitch for turning the microswitch on/off.

4. The damping device as claimed in claim 3, wherein the motor is a one directional motor.

5. The damping device as claimed in claim 3, wherein the contacts are projected from the driving cam at left/right sides thereof with reference to a front thereof.

6. The damping device as claimed in claim 1, further comprising an elastic body for keeping the driving cam and the one end of the damper in contact.

7. The damping device as claimed in claim 1, further comprising:

an opening formed in the air duct; and a fastening bracket on an outside of the air duct in the vicinity of the opening and having an inside with which the driving cam is fitted, and an outside to which the motor is fitted.

8. The damping device as claimed in claim 1, further comprising a stopper fitted to the partition wall for stopping the damper when the damper blocks the air duct.

9. A damping device in a microwave oven, comprising:

a gate disposed within an air duct in the microwave oven and comprising a central pivot and a first end;

a cam rotatably mounted on a shaft and in contact with said first end, wherein said cam causes said gate to pivot about said central pivot when said cam rotates.

10. The damping device of claim 9, further comprising an electric motor configured to rotate said shaft.

11. The damping device of claim 10, further comprising:

an opening in said air duct, wherein said electric motor and said cam are mounted outside of said air duct proximate to said opening, and said gate is disposed within said air duct such that said first end communicates with said cam through said opening.

12. The damping device of claim 10, further comprising a controller configured to control rotation of said shaft by said electric motor.

13. The damping device of claim 12, wherein said control means comprises:

a microcomputer electrically coupled to said electric motor; and a sensor electrically coupled to said electric motor, wherein said sensor communicates with said cam to detect an angular position of said cam.

14. The damping device of claim 13, wherein said sensor detects an angular position of said cam by mechanically contacting contacts provided on said cam.

15. The damping device of claim 10, wherein said electric motor is a unidirectional electric motor.

16. The damping device of claim 9, further comprising an elastic member configured to hold said first end in contact with said cam.

17. The damping device of claim 9, further comprising a stop located within said air duct, wherein said gate comprises a second end and said second end contacts said stop when said gate is in a closed position.

18. The damping device of claim 9, wherein said cam comprises a circular member with a wedge shaped cross-section.

19. The damping device of claim 9, wherein said cam comprises a circular member with a cross-section comprising a thin side, a thick side, and a curved section connection said thin side to said thick side.

20. The damping device of claim 9, wherein said gate comprises a contact member fixed on said first end and in slidable contact with said cam.

* * * * *